US005463694A

United States Patent [19]

Bradley et al.

[11] Patent Number: 5,463,694

[45] Date of Patent: Oct. 31, 1995

[54] GRADIENT DIRECTIONAL MICROPHONE SYSTEM AND METHOD THEREFOR

[75] Inventors: Wayne H. Bradley, Bloomingdale; Richard E. Werner, Hanover Park, both of Ill.

[73] Assignee: Motorola, Schaumburg, Ill.

[21] Appl. No.: 143,609

[22] Filed: Nov. 1, 1993

[51] Int. Cl.[6] ..... H04R 1/40

[52] U.S. Cl. ..... 381/92

[58] Field of Search ..... 381/92; 367/118, 367/124

[56] References Cited

U.S. PATENT DOCUMENTS

| | | | |
|---|---|---|---|
| 4,308,425 | 12/1981 | Momose et al. | 381/92 |
| 4,466,117 | 8/1984 | Gorike | 381/26 |
| 4,696,043 | 9/1987 | Iwahara et al. | 381/92 |
| 4,703,506 | 10/1987 | Sakamoto et al. | 381/92 |
| 4,712,244 | 12/1987 | Zwicker et al. | 381/68.1 |
| 4,742,548 | 5/1988 | Sessler et al. | 381/92 |
| 5,029,215 | 7/1991 | Miller, II | 381/92 |
| 5,058,170 | 10/1991 | Kanamori et al. | 381/92 |
| 5,121,426 | 6/1992 | Baumhauer, Jr. et al. | 379/388 |

OTHER PUBLICATIONS

Gradient Microphones, Harry F. Olson, RCA Laboratories, Oct. 25, 1945, The Journal of the Acoustical Society of American vol. 17, No. 3, Jan. 1946.

*Primary Examiner*—Stephen Brinich
*Attorney, Agent, or Firm*—Kevin D. Kaschke

[57] ABSTRACT

A gradient directional microphone system (100) and method therefor includes no more than three microphones (101, 103, 105) and a processor (107). Each of the microphones (101, 103, 105) have substantially the same gradient order (135, 137, 139) and frequency response. Each microphone produces an electrical signal (109, 111, 113) that is responsive to sound pressure (119, 121, 123) at each microphone (101, 103, 105). The processor (107) is coupled to receive the electrical signal (109, 111, 113) from each microphone (101,103, 105), and operative to produce an output signal (131) for the gradient directional microphone system (100) having a gradient order (141) at least two gradient orders higher than the gradient order (135, 137, 139) of each of the microphones (101, 103, 105). Using the present invention, the size and complexity of the gradient directional microphone system (100) is substantially reduced over that of the prior art.

16 Claims, 4 Drawing Sheets

GRADIENT DIRECTIONAL MICROPHONE SYSTEM AND METHOD THEREFOR

FIELD OF THE INVENTION

The present invention relates generally to directional microphone systems and, more particularly, to a gradient directional microphone system and method therefor.

BACKGROUND OF THE INVENTION

A directional microphone system is a microphone system having a directivity pattern. The directivity pattern describes the directional microphone system's sensitivity to sound pressure from different directions. The purpose of the directional microphone system is to receive sound pressure originating from a desirable sound source, such as speech, and attenuate sound pressure originating from an undesirable sound source, such as noise. The directional microphone system is typically used in noisy environments, such as in a vehicle or in a public place. An advantage of the directional microphone system is that the directivity pattern of the directional microphone system can be made more specific than that achieved through the use of a discrete microphone.

The directional microphone system generally includes a plurality of discrete microphones, each characterized by a directivity pattern, and a processor to produce the directivity pattern. Each discrete microphone produces an electrical signal responsive to sound pressure originating from both the desired and undesired sound sources. The processor processes the electrical signal from each microphone to produce an output signal having the directivity pattern of the directional microphone system.

One type of directional microphone system is a gradient directional microphone system. The gradient directional microphone system is similar to directional microphone systems except that the directivity pattern of the gradient directional microphone system is responsive to the difference in sound pressure between two discrete microphones. Because the gradient directional microphone system is responsive to the difference in sound pressure between two discrete microphones, the discrete microphones are generally located on a common axis with the desired sound source. Otherwise, the sound pressure at each discrete microphone would arrive at the same time. The gradient directional microphone system is advantageously used when the space and processing complexity for a particular application limits the number of discrete microphones.

Gradient directional microphone systems are characterized by a gradient order which defines the directivity pattern of the system. The gradient order of a gradient directional microphone system defines the degree of directionality of the system. In general, the higher the gradient order of the system the more directional the gradient directional microphone system becomes. For example, a gradient directional microphone system having a gradient order of zero implies an omnidirectional system having a directivity pattern in the shape of a circle. For example, a gradient directional microphone system having a gradient order of one can generate a directivity pattern anywhere between a figure eight pattern and a cardiod pattern. For example, a gradient directional microphone system having a gradient order of two generates a directivity pattern that can be represented as the product of the directivity pattern from two first order gradients.

A problem with the gradient directional microphone system is that the size and complexity, and therefore cost, of the system increases as the gradient order of the system increases. The size increases because additional discrete microphones are needed. The complexity increases because the processor processes electrical signals from the additional discrete microphones. The problem typically occurs when the gradient directional microphone system has a gradient order of two or more.

In the prior art, gradient directional microphone systems having a second order gradient comprise no less than four microphone ports. In one embodiment, the four microphone ports are constructed using four discrete microphones, wherein each discrete microphone has a zero order gradient. A disadvantage with using the four microphones is the space required for each discrete microphone and the distance required between adjacent discrete microphones.

In another embodiment, the four microphone ports are constructed using two discrete microphones, wherein each discrete microphone has a first order gradient and has dual microphone ports. A baffle may be placed between the dual microphone ports to separate the dual microphone ports. If a baffle is not used, the distance between the two discrete microphones must be increased beyond that need with a baffle. A disadvantage with using the four microphone ports constructed using two discrete microphones is that the baffle consumes space or that the distance between the discrete microphones is increased.

In both prior art embodiments, the processor requires the complexity necessary to process signals received from four microphone ports.

Accordingly, there is a need for a gradient directional microphone system having smaller size and less complexity.

SUMMARY OF THE INVENTION

In accordance with the present invention, the foregoing need is substantially met by a gradient directional microphone system and method therefor. The gradient directional microphone system and method therefor comprises no more than three microphones and a processor. Each of the microphones have substantially the same gradient order and frequency response. Each microphone produces an electrical signal that is responsive to sound pressure at each microphone. The processor is coupled to receive the electrical signal from each microphone, and operative to produce an output signal for the gradient directional microphone system having a gradient order at least two gradient orders higher than the gradient order of each of the microphones. Using the present invention, the size and complexity of the gradient directional microphone system is substantially reduced over that of the prior art.

DETAILED DESCRIPTION OF A PREFERRED EMBODIMENT

In accordance with the present invention, the foregoing need is substantially met by a gradient directional microphone system and method therefor. According to one embodiment of the present invention, the gradient directional microphone system includes three microphones and a processor. Each of the three microphones have substantially the same gradient order and frequency response. Each microphone produces an electrical signal that is responsive to sound pressure at each microphone. The processor is coupled to receive the electrical signal from each microphone, and operative to produce an output signal for the gradient directional microphone system having a gradient order at least two gradient orders higher than the gradient order of each of the three microphones. Using the present invention, the size and complexity of the gradient directional microphone system is substantially reduced over that of the prior art.

A detailed description of a preferred embodiment of the present invention can be better understood when read with reference to the accompanying drawings illustrated in FIGS. 1–5.

Figure 1:
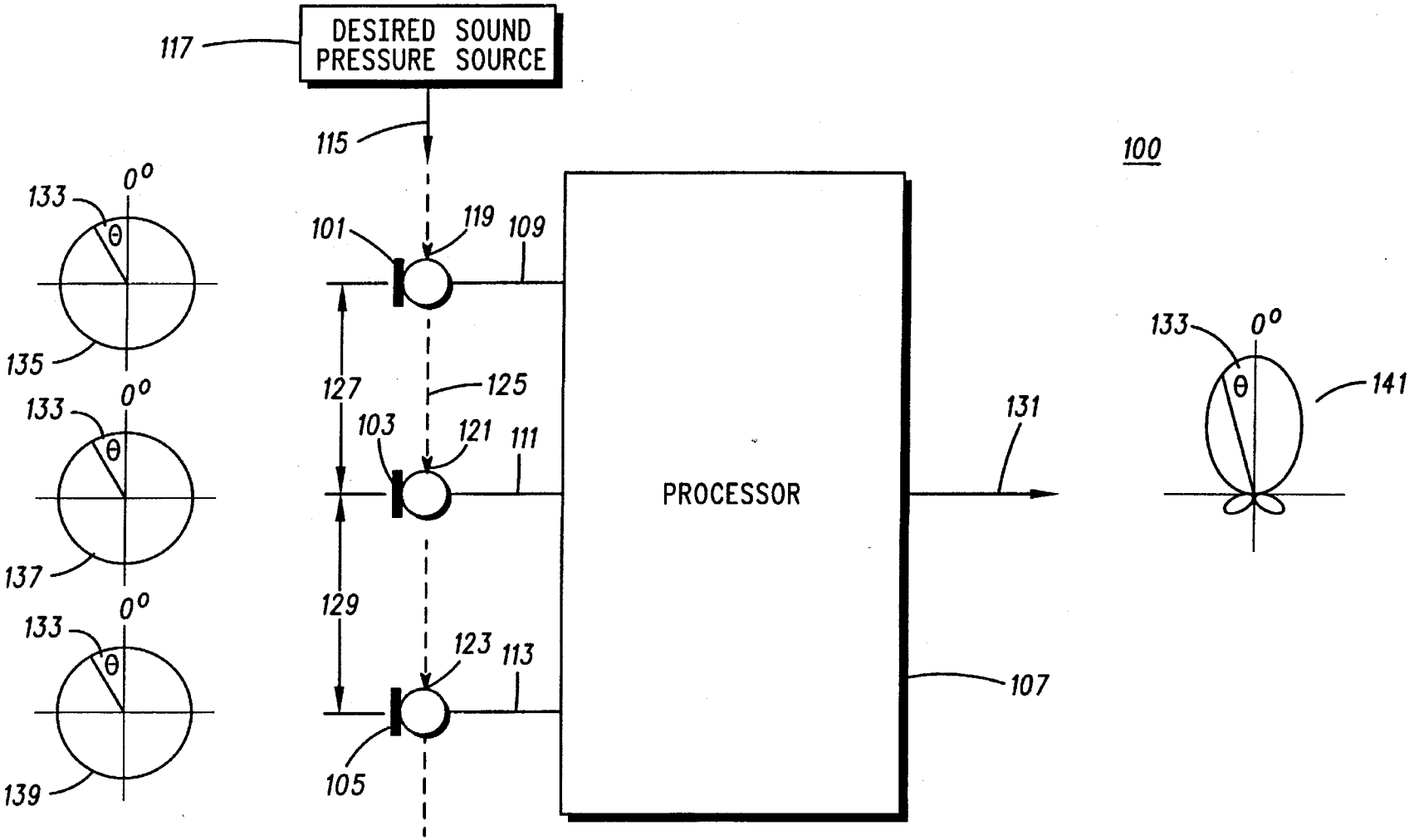
FIG. 1 illustrates a block diagram of a gradient directional microphone system, in accordance with the present invention.

FIG. 1 illustrates a gradient directional microphone system 100, in accordance with the present invention. The gradient directional microphone system 100 of the present invention generally includes a first 101, a second 103, and a third 105 microphone, and a processor 107. In accordance with the present invention, the three microphones 101, 103 and 105 each have a gradient order and a frequency response substantially the same for the three microphones.

The first 101, second 103, and third 105 microphone produces a first 109, second 111, and third 113 electrical signal, respectively, responsive to sound pressure at each microphone. The sound pressure, as indicated by arrow 115, is at least partially produced by a desired sound pressure source 117. The three microphones 101, 103 and 105 are positioned on a common axis 125 with the desired sound pressure source 117. The sound pressure at the first 101, second 103, and third 105 microphone is represented by arrows 119, 121, and 123, respectively. Because the microphones are spaced apart the sound pressure at each microphone has substantially the same level but is delayed in time with respect to the sound pressure 115 generated by the desired sound pressure source 117.

In accordance with the present invention the processor 107 is coupled to receive the electrical signals 109, 111, and 113 from each respective microphone 101, 103, and 105, and operative to produce an output signal at line 131 for the gradient directional microphone system having a gradient order 141 at least two gradient orders higher than the gradient order of each of the three microphones.

According to the preferred embodiment of the present invention, the three microphones 101, 103, and 105 each have a gradient order of zero which is represented by a directivity pattern 135, 137, 139 shown next to each microphone. The directivity pattern for each microphone has equal sensitivity for all angles of incidence 133. The gradient order realized by the gradient directional microphone system 100 is represented by the directivity pattern 141. The directivity pattern 141 is represented by the following equation:

$$y=\frac{k}{s}\left[\frac{k}{s}(m_1-2m_2+m_3)+\frac{1}{2}(m_1-m_3)\right] \quad [1]$$

Where y is the output, the 1/s term denotes integration, k is a scaling constant that is proportional to the speed of sound divided by the space between microphones, and $m_1$, $m_2$, $m_3$ are the electrical signals 109, 111, 113 from the three microphones. The signals $m_2$ and $m_3$ can be written in terms of $m_1$ by the following equations:

$$m_2=m_1e^{-st} \quad [2]$$

$$m_3=m_1e^{-s2t} \quad [3]$$

$$t=\frac{\cos(\theta)}{k} \quad [4]$$

Where θ is the angle of incidence 133. The final output y is then derived by the following:

$$y=\frac{k}{s}\left[\frac{k}{s}(m_1-2m_2+m_3)+\frac{1}{2}(m_1-m_3)\right] \quad [1]$$

$$=m_1\frac{k}{s}\left[\frac{k}{s}(1-e^{-st})(1-e^{-st})+\frac{1}{2}(1-e^{-st})(1+e^{-st})\right] \quad [5]$$

$$=m_1e^{-st}\frac{k}{s}(e^{st/2}-e^{-st/2})\left[\frac{k}{s}(e^{st/2}-e^{-st/2})+\frac{1}{2}(e^{st/2}+e^{-st/2})\right] \quad [6]$$

$$=m_2\frac{2k}{\omega}\sin\left(\frac{\omega t}{2}\right)\left[\frac{2k}{\omega}\sin\left(\frac{\omega t)}{2}\right)+\cos\left(\frac{\omega t}{2}\right)\right] \quad [7]$$

For $k > \omega$:

$$\cong m_2\cos(\theta)[\cos(\theta)+1] \quad [8]$$

The directivity pattern 141 is generally unidirectional in that the gradient directional microphone system 100 is sensitive to sound pressure 115 received from the direction of the sound pressure source 117 and is substantially insensitive to sound pressure received from all other directions.

An advantage of the gradient directional microphone system 100 is that only three zero order gradient microphones 101, 103, 105 are used to produce the output signal 131 having a second order gradient directivity pattern 141. By contrast, the prior art required four zero order gradient microphones in order to produce an output signal having a second order gradient directivity pattern. Thus, in the present invention, using one less zero order gradient microphone significantly reduces the size of the gradient directional microphone system 100. According to the present invention, the benefits of reduced size are achieved using the novel processor 107.

In the preferred embodiment of the present invention, the distance between adjacent microphones 127 and 129 is approximately 25 millimeters. Therefore, this corresponds to an overall package length of about 60 millimeters.

In the preferred embodiment of the present invention, the constant k is equal to the speed of sound divided by the microphone spacing. Alternate output directivity patterns may be achieved by scaling this constant k. A narrow bi-directional pattern at the output of the gradient directional microphone system is one example of an alternate directivity pattern formed by scaling the constant k.

In the preferred embodiment of the present invention, a final integration stage (not shown) may optionally be added to the output of the processor 107 to integrate the output signal 131. The final integration stage is advantageous for gradient directional microphone systems intended for use in large rooms or open areas. However, when the gradient directional microphone system is used in small rooms or automobiles, for example, a build up of low frequency sound produces an effect equivalent to integration.

The gradient directional microphone system 100 of the present invention may advantageously be used as a part of another gradient microphone system having more than three microphones and achieving a gradient order higher than the gradient order achieved by the three microphones.

Figure 2:
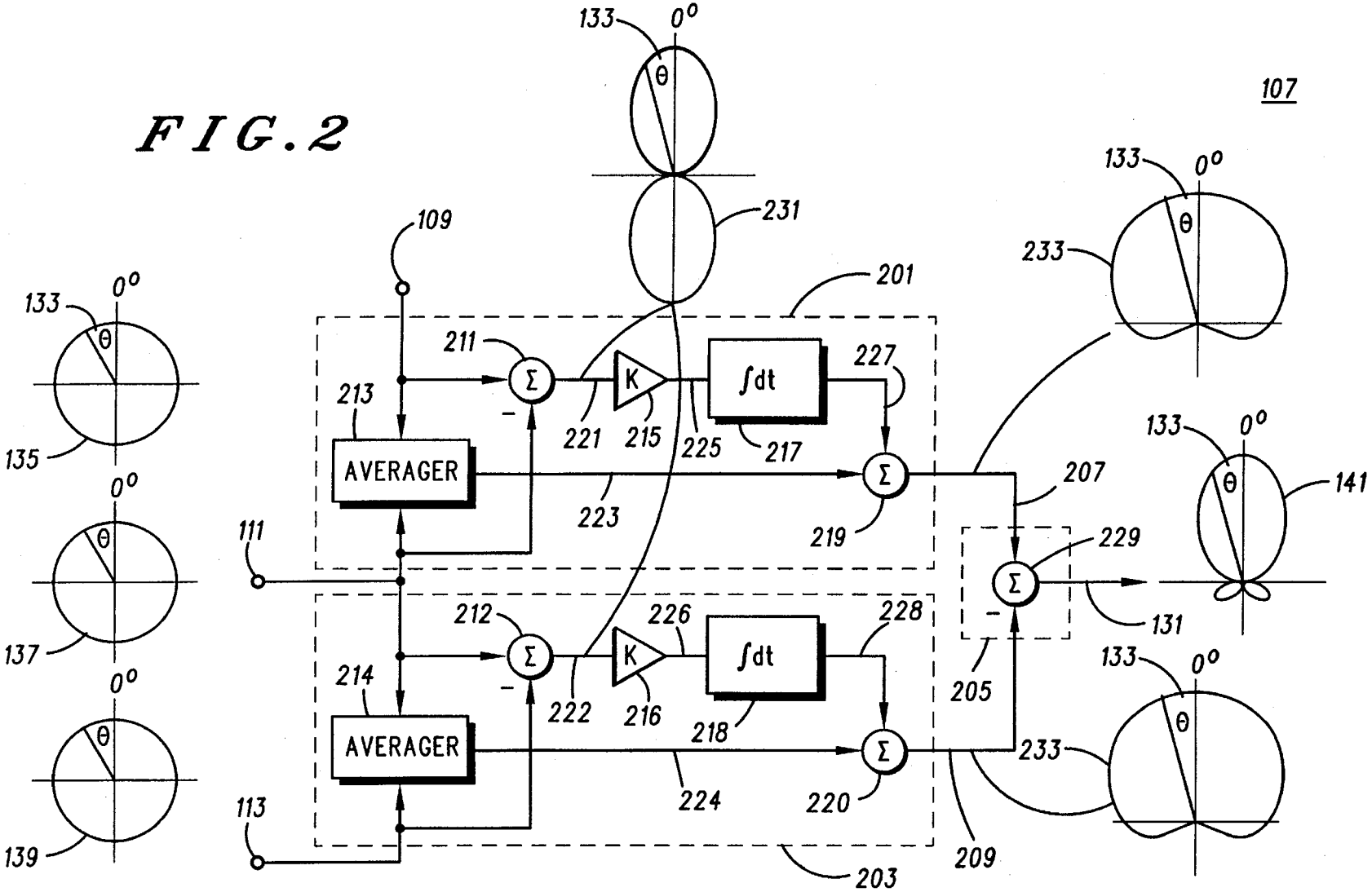
FIG. 2 illustrates a block diagram of intermediate acoustic processing of a processor used in the gradient directional microphone system of FIG. 1, in accordance with the present invention.
Figure 3:
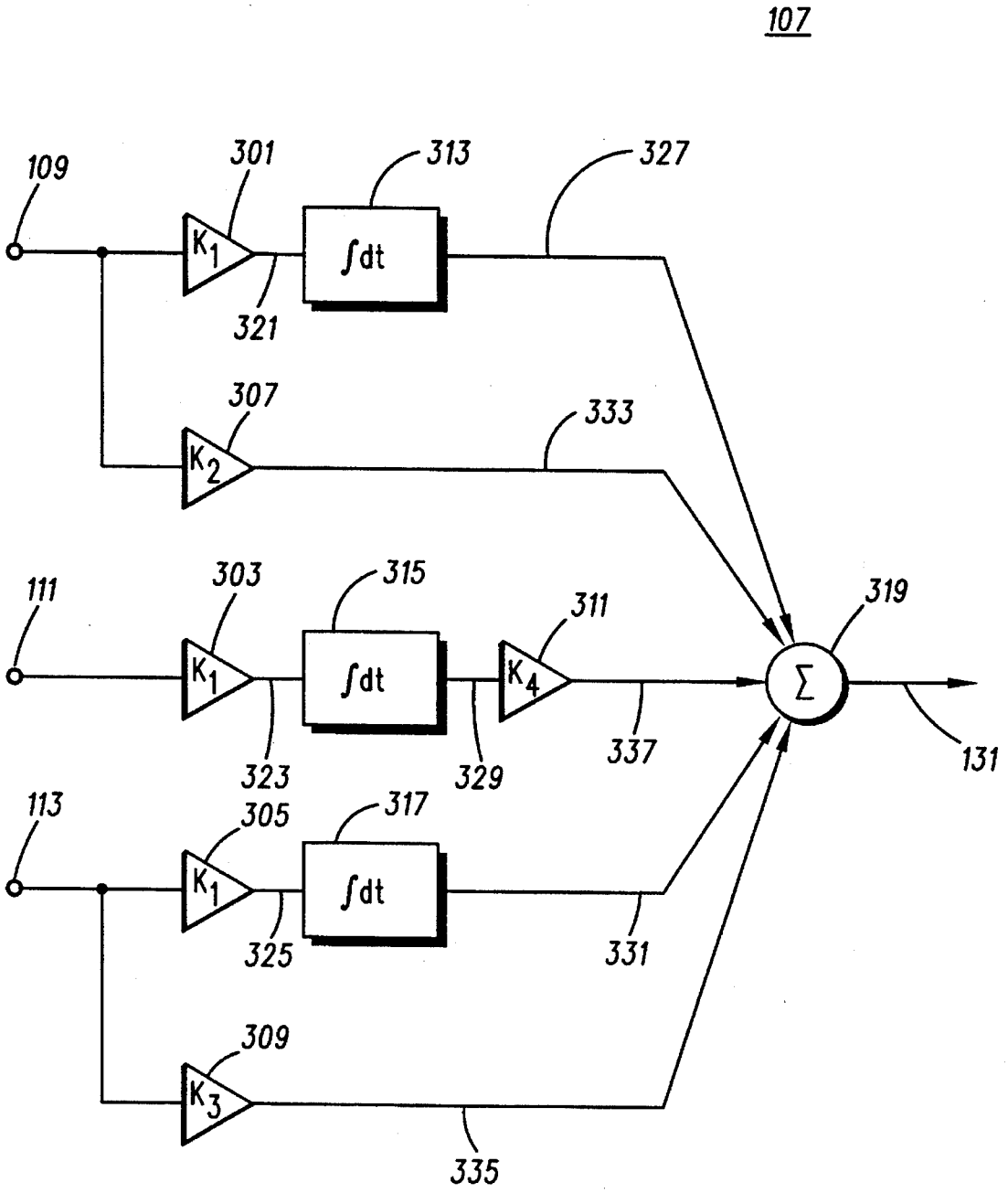
FIG. 3 illustrates a block diagram of electrical signal processing of individual microphone signals in a processor used in the gradient directional microphone system of FIG. 1, in accordance with the present invention.
Figure 4:
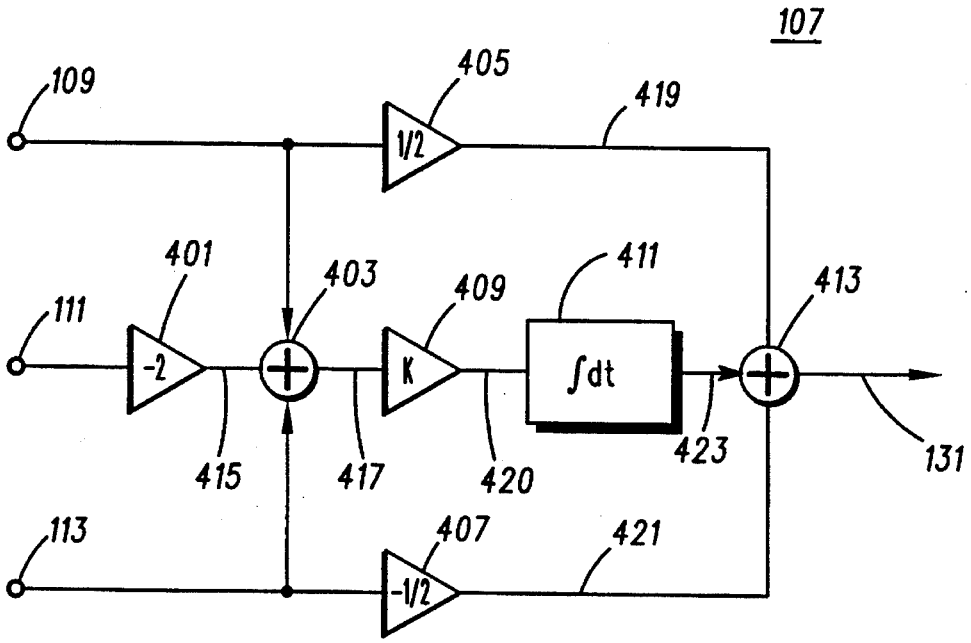
FIG. 4 illustrates a block diagram of an economical implementation of a processor used in the gradient directional microphone system of FIG. 1, in accordance with the present invention.

FIGS. 2–4 represent alternate block diagrams for the processor 107 of FIG. 1. The function performed by each of the block diagrams is the same. FIG. 2 represents a block diagram of the processor from an acoustic point of view. FIG. 3 represents a block diagram of the processor from an electrical point of view. FIG. 4 represents a block diagram of the processor from an economic implementation point of view.

FIG. 2 illustrates a block diagram of intermediate acoustic processing of the processor 107 used in the gradient directional microphone system 100 of FIG. 1, in accordance with the present invention. The processor 107 generally includes a first 201, second 203, and third 205 gradient determiner. The first gradient determiner 201 is coupled to receive the first 109 and the second 111 electrical signal, and operative to produce a first gradient signal at line 207. The second gradient determiner 203 is coupled to receive the second and third electrical signals at lines 111 and 113, respectively, and operative to produce a second gradient signal at line 209. The third gradient determiner 205 is coupled to receive the first and second gradient signals at lines 207 and 209, and operative to produce the output signal at line 131.

The first and second gradient signals at lines 207 and 209, have a first order gradient represented by a directivity pattern 233. Preferably, the directivity pattern 233 is a cardiod pattern; however, in other applications the directivity pattern 233 may be another pattern representative of a first order gradient. Other directivity patterns for first order gradient directional microphone systems may include bi-directional directivity patterns such as the shape of a figure eight.

In accordance with the preferred embodiment of the present invention, the first gradient determiner generally includes an averager 213, a subtractor 211, an amplifier 215, an integrator 217, and a summer 219. Individually the averager 213, the subtractor 211, the amplifier 215, the integrator 217, and the summer 219 are well known in the art thus no further discussion will be presented except to facilitate the understanding of the present invention.

The subtractor 211 subtracts the second electrical signal 111 from the first electrical signal 109 to produce a subtracted signal at line 221. The averager 213 averages the first and second electrical signals at lines 109 and 111, respectively to produce an averages signal at line 223. The amplifier 215 amplifies the subtracted signal at line 221 to produce an amplified signal at line 225. The integrator 217 integrates the amplified signal at line 225 to produce an integrated signal at line 227. The summer 219 sums the integrated signal at line 227 and the averaged signal at line 223 to produce the first gradient signal 207.

In the preferred embodiment of the present invention, the subtracted signal at line 221 for the gradient directional microphone system has a first order gradient represented by the directivity pattern 231. The directivity pattern 231 preferably has bi-directional sensitivity indicated by the balanced figure eight shape.

The second gradient determiner 203 has the same structure and performs a similar function on the second and third electrical signal at lines 111 and 113, respectively, to produce the second gradient signal at line 209.

The third gradient determiner generally includes a subtractor 229 for subtracting the second gradient signal at line 209 from the first gradient signal 207 to produce the output signal at line 131 for the gradient directional microphone system.

FIG. 3 illustrates a block diagram of electrical signal processing of individual microphone signals 109, 111, 113 in the processor 107 used in the gradient directional microphone system 100 of FIG. 1, in accordance with the present invention. The processor 107 generally includes a first 301, a second 303, a third 305, a fourth 307, a fifth 309, and a sixth 311 amplifier, and a first 313, a second 315, and a third 317 integrator, and a summer 319. Individually, each of the elements represented in the processor 107 as shown in FIG. 3 is well known in the art, thus no further description will be presented except to facilitate the understanding of the present invention.

The first 301, the second 303, and the third 305 amplifiers amplify the first 109, the second 111, and the third 113 electrical signals, respectively by a first constant, $K_1$, to produce a first, a second, and a third amplified signal at lines 321,323, and 325 respectively. The first constant $K_1$, is proportional to the ratio of the speed of sound to the distance between adjacent microphones. The first integrator 313 integrates the first amplified signal at line 321 to produce a first integrated signal at line 327. The second integrator integrates the second amplified signal at line 323 to produce a second integrated signal at line 329. The third integrator 317 integrates the third amplified signal at line 325 to produce a third integrated signal at line 331. The fourth amplifier 307 amplifies the first electrical signal at line 109 by a constant $K_2$ to produce a fourth amplified signal at line 333. The fifth amplifier 309 amplifies the third electrical signal at line 113 by a constant $K_3$, having an opposite sign to the second constant $K_2$, to produce a fifth amplified signal at line 335. The sixth amplifier 311 amplifies the second integrated signal at line 329 to produce a sixth amplified signal at line 337. The summer 319 sums the first integrated signal at line 327, the fourth amplified signal at line 333, the sixth amplified signal at line 337, the third integrated signal at line 331, and the fifth amplified signal at line 335 to produce the output signal at line 131 of the processor 107.

FIG. 4 illustrates a block diagram of an economical implementation of the processor 107 used in the gradient directional microphone system 100 of FIG. 1, in accordance with the present invention. The gradient directional microphone system of FIG. 4 generally includes a first inverting amplifier 401, a first summer 403, an attenuator 405, an inverting attenuator 407, an amplifier 409, an integrator 411, and a second summer 413. Individually, each element of the processor 107 represented in FIG. 3 is well known in the art, thus no further discussion will be presented except to facilitate the understanding of the present invention.

The first inverting amplifier 401 inverts the magnitude of the second electrical signal at line 111 proportional to the magnitude of the first and third electrical signals at lines 109 and 113 respectively, and amplifying the second electrical signal at line 111 to produce an inverted amplified signal at line 415. The first summer sums the first electrical signal at line 109, the third electrical signal at line 113, and the first inverted amplified signal at line 415 to produce a first summed signal at line 417. The attenuator 405 attenuates the first electrical signal at line 109 to produce an attenuated signal at line 419. The inverting attenuator 407 attenuates the third electrical signal at line 113, and inverts the magnitude of the third electrical signal at line 113 proportional to the magnitude of the first electrical signal at line 109 to produce an inverted attenuated signal at line 421. The amplifier 409 amplifies the first summed signal at line 417 by a constant K to produce an amplified signal at line 420. The constant K represents a gain of the amplifier 409 proportional to the ratio of the speed of sound to the distance between adjacent microphones. The integrator 411 integrates the amplified signal at line 420 to produce an integrated signal at line 423. The summer 413 sums the attenuated signal at line 419, the inverted attenuated signal at line 421 and the integrated signal at line 423 to produce the output signal at line 131 for the gradient directional microphone system.

The advantage of the block diagram of the processor 107 represented in FIG. 3 is that the processor 107 has reduced complexity over the representations of the processor 107 in FIGS. 2 and 3 and the prior art.

Figure 5:
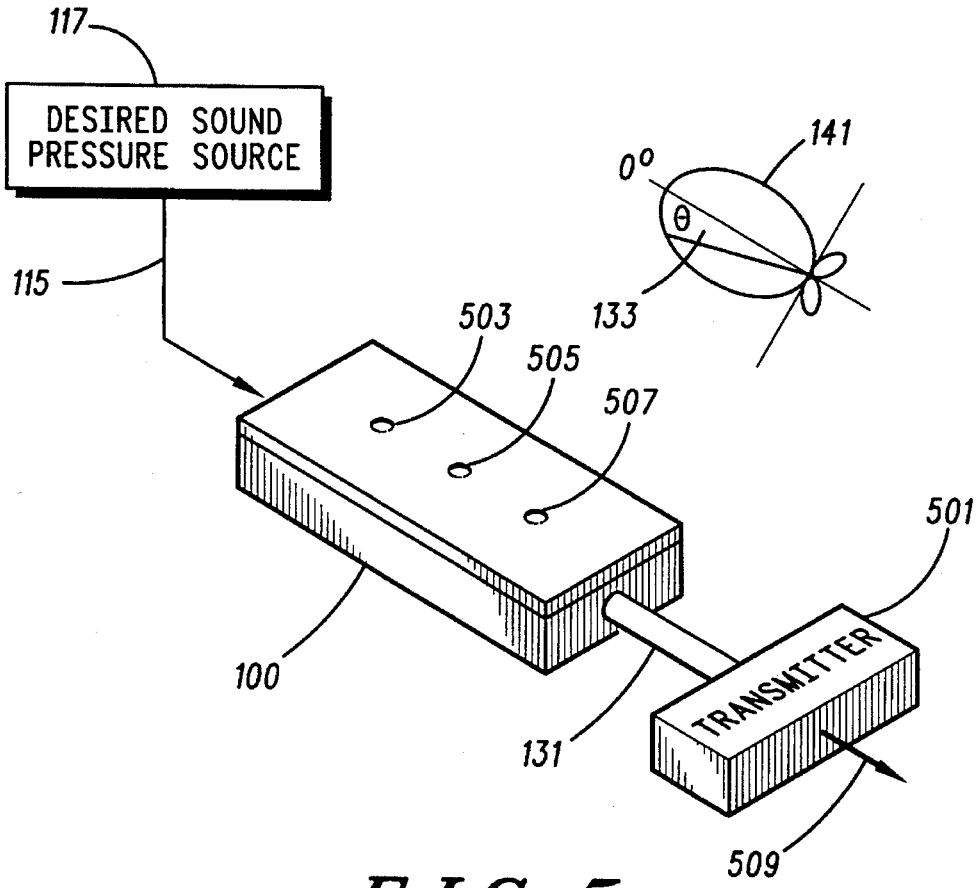
FIG. 5 illustrates a communication system including the gradient directional microphone system of FIG. 1, in accordance with the present invention.

FIG. 5 illustrates a communication system 500 using the gradient directional microphone system 100 of FIG. 1 in accordance with the present invention. The communication system 400 generally includes the gradient directional microphone system 100 of FIG. 1 coupled to a transmitter 501. The sound pressure source 117 generates sound pressure 115 in the direction of the gradient directional microphone system 100. Particularly, the sound pressure 115 is directed towards the gradient directional microphone system 100 at an angle of incidence 133 of zero degrees as illustrated by the directivity pattern 141. The gradient directional microphone system 100 includes a first 503, a second 505, and a third 507 input port for receiving the sound pressure 115 at the first 101, the second 103, and the third 105 microphone, respectively. The gradient directional microphone system 100 processes the input from the three ports 503, 505, and 507 using the processor 107 to produce the output signal 131. The output signal 131 is coupled to the transmitter 501 wherein the transmitter transmits the output signal 131 at line 509.

In the preferred embodiment, the communication system 500 is a radiotelephone system wherein the gradient directional microphone system 100 represents a handsfree microphone and the transmitter 501 represents a portion of the radiotelephone's circuitry. Alternatively, the communication system 500 may also represent a dispatch communication system wherein the gradient directional microphone system 100 represents a desktop microphone and the transmitter 501 represents a controller coupled to a landline telephone network. Alternatively, the communication system 500 may also represent a hearing aid device wherein the gradient directional microphone system 100 receives sound from a specific direction away from a user and the transmitter 501 processes those sounds for input to the user's ear.

Thus, the present invention provides a gradient directional microphone system and method therefor. Using the present invention, the size and complexity of the gradient directional microphone system is substantially reduced over that of the prior art. These advantages are generally provided by a gradient directional microphone system having three microphones whose signals are processed in a unique manner. With the present invention, the problems of large size and high complexity of prior art gradient directional microphone system are substantially resolved.

While the present invention has been described with reference to illustrative embodiments thereof, it is not intended that the invention be limited to these specific embodiments. Those skilled in the art will recognize that variations and modifications can be made without departing from the spirit and scope of the invention as set forth in the appended claims.

What is claimed is:

1. A gradient directional microphone system comprising:

no more than three microphones, each of the microphones having a gradient order and a frequency response that is substantially the same, each microphone producing an electrical signal responsive to sound pressure at each microphone, and a processor coupled to receive the electrical signal from each microphone and operative to produce an output signal for the gradient directional microphone system having a gradient order at least two gradient orders higher than the gradient order of each of the microphones.

2. A gradient directional microphone system according to claim 1, wherein the electrical signal produced by each of the microphones includes first, second and third electrical signals corresponding to first, second and third microphones, and wherein the processor further comprises:

a first gradient determiner coupled to receive the first and second electrical signals and operative to produce a first gradient signal;

a second gradient determiner coupled to receive the second and third electrical signals and operative to produce a second gradient signal; and a third gradient determiner coupled to receive the first and second gradient signals and operative to produce the output signal.

3. A gradient directional microphone system according to claim 2, wherein the first gradient determiner further comprises:

a subtractor for subtracting the second electrical signal from the first electrical signal to produce a subtracted signal;

an averager for averaging the first and second electrical signals to produce an averaged signal;

an amplifier for amplifying the subtracted signal to produce an amplified signal;

an integrator for integrating the amplified signal to produce an integrated signal; and a summer for summing the integrated signal and the averaged signal to produce the first gradient signal.

4. A gradient directional microphone system according to claim 2 wherein the second gradient determiner further comprises:

a subtractor for subtracting the third electrical signal from the second electrical signal to produce a subtracted signal;

an averager for averaging the second and third electrical signals to produce an averaged signal;

an amplifier for amplifying the subtracted signal to produce an amplified signal;

an integrator for integrating the amplified signal to produce an integrated signal; and a summer for summing the integrated signal and the averaged signal to produce the second gradient signal.

5. A gradient directional microphone system according to claim 2 wherein the third gradient determiner further comprises:

a subtractor for subtracting the second gradient signal from the first gradient signal to produce the output signal of the gradient directional microphone system.

6. A gradient directional microphone system according to claim 1, wherein the electrical signal produced by each of the microphones includes first, second and third electrical signals corresponding to first, second and third microphones, and wherein the processor further comprises:

a first inverting amplifier for inverting the magnitude of second electrical signal relative to the magnitude of the first and third electrical signals, and amplifying the second electrical signal to produce an inverted amplified signal;

a first summer for summing the first electrical signal, the third electrical signal, and the first inverted amplified signal to produce a first summed signal;

an attenuator for attenuating the first electrical signal to produce an attenuated signal;

an inverting attenuator inverting the magnitude of the third electrical signal relative to the magnitude of the first electrical signal, and for attenuating the third electrical signal to produce an inverted attenuated signal;

an amplifier, having gain proportional to the ratio of the speed of sound to a distance between adjacent microphones, for amplifying the first summed signal to produce an amplified signal;

an integrator for integrating the amplified signal to produce an integrated signal; and a second summer for summing the attenuated signal, the inverted attenuated signal and the integrated signal to produce the output signal for the gradient directional microphone system.

7. A gradient directional microphone system according to claim 1, wherein the electrical signal produced by each of the microphones includes first, second and third electrical signals corresponding to first, second and third microphones, and wherein the processor further comprises:

first, second and third amplifiers for amplifying the first, second and third electrical signals, respectively, by a first constant, proportional to the ratio of the speed of sound to a distance between adjacent microphones, to produce first, second and third amplified signals, respectively;

first, second and third integrators for integrating each of the first, second and third amplified signals, respectively, to produce first, second and third integrated signals, respectively;

a fourth amplifier for amplifying the first electrical signal by a second constant to produce a fourth amplified signal;

a fifth amplifier for amplifying the third electrical signal by a third constant, having an opposite sign to the second constant, to produce a fifth amplified signal;

a sixth amplifier for amplifying the second integrated signal by a fourth constant to produce a sixth amplified signal; and a summer for summing the first and third integrated signals, and the fourth, fifth, and sixth amplified signals to produce the output signal of the gradient directional microphone system.

8. A communication system comprising:

a gradient directional microphone system including:

no more than three microphones, each of the microphones having a gradient order and a frequency response that is substantially the same, each microphone producing an electrical signal responsive to sound pressure at each microphone; and a processor coupled to receive the electrical signal from each microphone and operative to produce an output signal for the gradient directional microphone system having a gradient order at least two gradient orders higher than the gradient order of each of the microphones; and a transmitter for transmitting the output signal of the gradient directional microphone system.

9. A method for operating a gradient directional microphone system including no more than three microphones, each of the microphones having a gradient order and a frequency response that is substantially the same, each microphone producing an electrical signal that is responsive to sound pressure at each microphone, the method comprising the step of:

processing the electrical signal from each microphone to produce an output signal for the gradient directional microphone system having a gradient order at least two gradient orders higher than the gradient order of each of the microphones.

10. A method of operating the gradient directional microphone system according to claim 9, wherein the electrical signal produced by each of the microphones includes first, second and third electrical signals corresponding to first, second and third microphones, and wherein the step of processing further comprises the steps of:

determining a first gradient signal responsive to the first and second electrical signals;

determining a second gradient signal responsive to the second and third electrical signals; and determining the output signal for the gradient directional microphone system responsive to the first and second gradient signals.

11. A method of operating the gradient directional microphone system according to claim 10, wherein the step of determining the first gradient signal further comprises the steps of:

subtracting the second electrical signal from the first electrical signal to produce a subtracted signal;

averaging the first and second electrical signals to produce an averaged signal;

amplifying the subtracted signal to produce an amplified signal;

integrating the amplified signal to produce an integrated signal; and summing the integrated signal and the averaged signal to produce the first gradient signal.

12. A method of operating a gradient directional microphone system according to claim 10, wherein the step of determining the second gradient signal further comprises the steps of:

subtracting the third electrical signal from the second electrical signal to produce a subtracted signal;

averaging the second and third electrical signals to produce an averaged signal;

amplifying the subtracted signal to produce an amplified signal;

integrating the amplified signal to produce an integrated signal; and summing the integrated signal and the averaged signal to produce the second gradient signal.

13. A method of operating a gradient directional microphone system according to claim 10, wherein the step of determining the third gradient signal further comprises the step of:

subtracting the second gradient signal from the first gradient signal to produce the output signal of the gradient directional microphone system.

14. A method of operating a gradient directional microphone system according to claim 9, wherein the electrical signal produced by each of the microphones includes first, second and third electrical signals corresponding to first, second and third microphones, and wherein the step of processing further comprises the steps of:

inverting the magnitude of second electrical signal relative to the magnitude of the first and third electrical signals, and amplifying the second electrical signal to produce an inverted amplified signal;

summing the first electrical signal, the third electrical signal, and the first inverted amplified signal to produce a first summed signal;

attenuating the first electrical signal to produce an attenuated signal;

inverting the magnitude of the third electrical signal relative to the magnitude of the first electrical signal, and attenuating the third electrical signal to produce an inverted attenuated signal;

amplifying the first summed signal by a gain, proportional to the ratio of the speed of sound to a distance between adjacent microphones, to produce an amplified signal;

integrating the amplified signal to produce an integrated signal; and summing the attenuated signal, the inverted attenuated signal and the integrated signal to produce the output signal for the gradient directional microphone system.

15. A method of operating a gradient directional microphone system according to claim 9, wherein the electrical signal produced by each of the microphones includes first, second and third electrical signals corresponding to first, second and third microphones, and wherein the step of processing further comprises the steps of:

amplifying each of the first, second and third electrical signals by a first constant, proportional to the ratio of the speed of sound to a distance between adjacent microphones, to produce first, second and third amplified signals, respectively;

integrating each of the first, second and third amplified signals to produce first, second and third integrated signals, respectively;

amplifying the first electrical signal by a second constant to produce a fourth amplified signal;

amplifying the third electrical signal by a third constant, having an opposite sign to the second constant, to produce a fifth amplified signal;

amplifying the second integrated signal by a fourth constant to produce a sixth amplified signal; and summing the first and third integrated signals, and the fourth, fifth, and sixth amplified signals to produce the output signal of the gradient directional microphone system.

16. A method for operating a communication system having a gradient directional microphone system including no more than three microphones, each of the microphones having a gradient order and a frequency response that is substantially the same for the three microphones, each microphone producing an electrical signal that is responsive to sound pressure at each microphone, the method comprising the steps of:

processing the electrical signal from each microphone to produce an output signal for the gradient directional microphone system having a gradient order at least two gradient orders higher than the gradient order of each of the microphones; and transmitting the output signal of the gradient directional microphone system.

* * * * *